United States Patent [19]

Cailey

[11] Patent Number: 4,926,812

[45] Date of Patent: May 22, 1990

[54] CYLINDER HEAD INTAKE MANIFOLD INTERFACE

[75] Inventor: Fred L. Cailey, Batavia, Ill.

[73] Assignee: Navistar International Transportation Corp., Chicago, Ill.

[21] Appl. No.: 431,046

[22] Filed: Nov. 2, 1989

[51] Int. Cl.[5] ..... F02F 1/24

[52] U.S. Cl. ..... 123/193 H; 123/52 M; 123/188 M

[58] Field of Search ..... 123/188 M, 193 H, 52 M, 123/52 MC

[56] References Cited

U.S. PATENT DOCUMENTS

| | | | |
|---|---|---|---|
| 1,129,605 | 2/1915 | Rounds . | |
| 1,205,095 | 11/1916 | Kelly . | |
| 1,364,543 | 1/1921 | Calow . | |
| 1,413,431 | 4/1922 | Roeling et al. . | |
| 1,768,136 | 6/1930 | Moorhouse . | |
| 1,771,886 | 7/1930 | Fekete et al. . | |
| 3,965,873 | 6/1976 | Kunomi et al. | 123/188 M |
| 4,318,372 | 3/1982 | Bracken et al. | 123/188 M |
| 4,441,470 | 4/1984 | Brophy | 123/306 |

FOREIGN PATENT DOCUMENTS

| | | | |
|---|---|---|---|
| 1179045 | 10/1964 | Fed. Rep. of Germany . | |
| 3511029 | 10/1985 | Fed. Rep. of Germany | 123/188 M |
| 0589216 | 3/1959 | Italy . | |
| 1339222 | 11/1972 | United Kingdom | 123/193 H |

*Primary Examiner*—Willis R. Wolfe
*Assistant Examiner*—M. Macy
*Attorney, Agent, or Firm*—F. David AuBuchon; Dennis K. Sullivan

[57] ABSTRACT

An improved configuration of the intake manifold interface of a diesel engine cylinder head includes semicylindrical columnar structures disposed adjacent intermeidater port inlets, the columnar structures being separated by a depressed chamber in the interface surface. The end port inlets are provided with a columnar structure to the inboard side thereof with the outboard side of each end port inlet being a smooth continuation of the inner wall of an intake manifold to be mated against a planar sealing surface disposed around the interface surface of the cylinder head.

14 Claims, 1 Drawing Sheet

CYLINDER HEAD INTAKE MANIFOLD INTERFACE

BACKGROUND OF THE INVENTION

The present invention relates to automotive internal combustion engines and an improved design for the intake manifold interface of the cylinder head thereof particularly of the type wherein the intake manifold delivers charge air to more than one intake port opening to the surface of the cylinder head within the manifold. More specifically, a depressed chamber in the surface of the cylinder head between adjacent intake ports is provided which enhances the flow of air into the intake port and improves the flow efficiency of the head and, accordingly, the volumetric efficiency of the engine.

THE PRIOR ART

Heretofore, various designs for the interface between the intake ports of a cylinder head and an intake manifold have been proposed to improve the flow of air or an air/fuel mixture into the combustion chamber. Among these are the provision of arcuate port walls which blend into the surface of the cylinder head to which the manifold is attached in an attempt to take advantage of the well known Coanda effect, i.e., the tendency of streamline flow to attach to and follow a curved surfaces. However, such attempts have not proven successful, probably because, within the confined area of an intake port, the boundary layer was so thick that it effectively masked any radius added at the port inlet because the size of the radius would necessarily be limited by practical considerations, such as port width, wall thickness, cylinder spacing, etc.

SUMMARY OF THE INVENTION

In the present invention, the depressed chamber in the cylinder head side wall in the area between adjacent intake ports has been found to provide increased air flow efficiency into the ports when air flows through the head are compared on a mass air flow of Mach index basis.

More specifically, in accordance with the invention, there is provided an improved configuration of the intake manifold side of a cylinder head wherein the intake port inlets thereof are provided on their sides adjacent another intake port with arcuate port entrances formed by semicylindrical columnar structures tangent to the plane of the port wall, the columns between adjacent ports being separated by a depressed area, preferably at least one half a column diameter deep. The port wall on the outboard side of each end port is adapted to mate smoothly with the inner surface of the intake manifold wall when the intake manifold is mounted on the cylinder head.

DESCRIPTION OF THE PREFERRED EMBODIMENT

Figure 1:
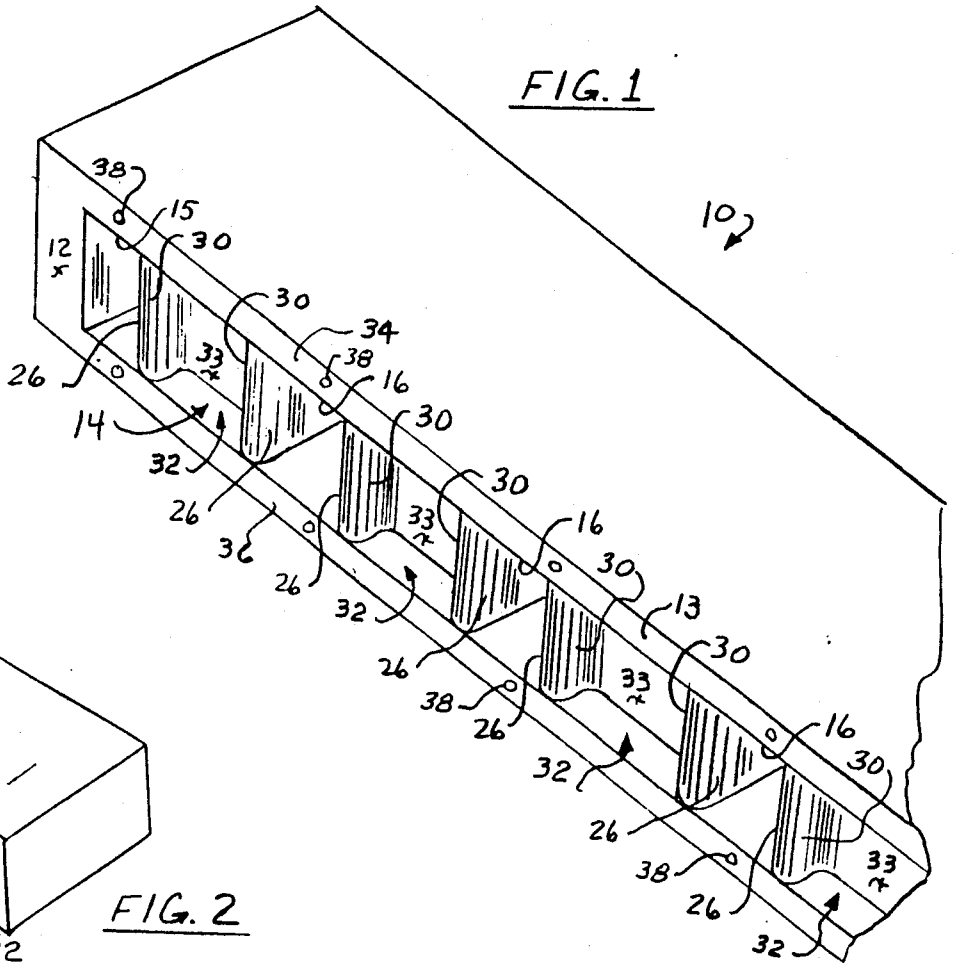
FIG. 1 is a perspective view of a cylinder head incorporating an intake manifold interface surface in accordance with the teachings of the invention.
Figure 2:
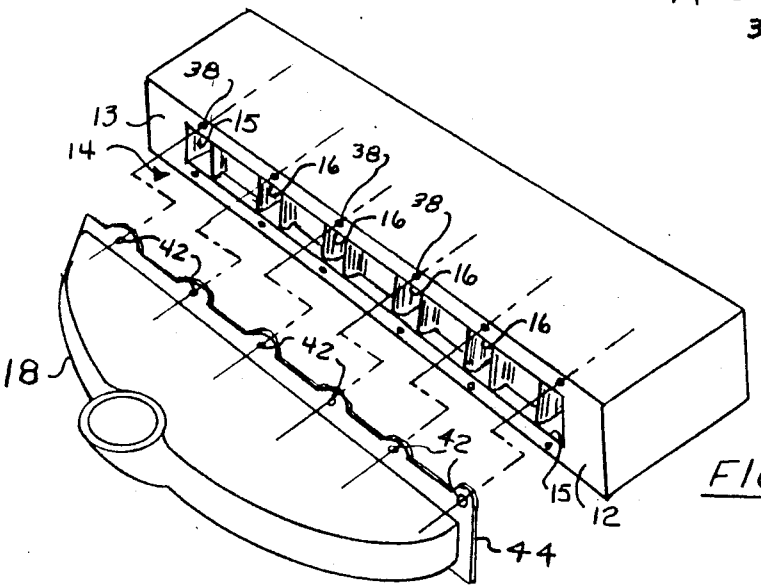
FIG. 2 is an exploded perspective view of the cylinder head of FIG. 1 shown in relation to an intake manifold to be seated and sealed thereagainst.

Referring now to the drawings in greater detail, there is illustrated an internal combustion engine cylinder head 10 having a side interface surface 12 including a planar periphery 13 adapted to receive an intake manifold 18 in sealing engagement thereagainst and an intake interface surface 14 within the planar periphery 13 and thus within the area enclosed by the intake manifold 18. It will be appreciated that with the exception of the interface surface 14, the cylinder head 10 may be an otherwise conventional diesel engine cylinder head. Consequently, major details such as fuel injector openings, intake and exhaust port configuration, valving, and cooling passages are omitted to simplify the disclosure of the invention.

Figure 3:
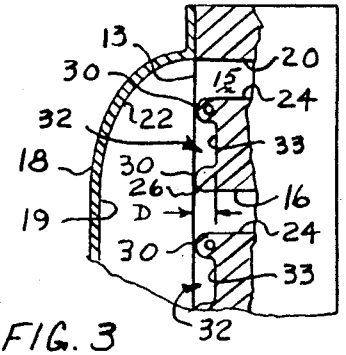
FIG. 3 is a top plan view partly in section of a portion of the cylinder head and intake manifold assembly of FIG. 2.

As shown in FIGS. 1 and 3, the interface surface 14 is intersected by two types of generally rectangular intake port inlets 15 and 16 extending therefrom into the cylinder head 10, the two end port inlets 15 and a plurality of intermediate port inlets 16 disposed between the end port inlets 15 being spaced therealong at regular intervals. The cyliner head 10 in this embodiment includes two end port inlets 15 and four intermediate port inlets 16. As shown in FIG. 3, the intake manifold 18 defines a single plenum 19 which feeds all of the intake port inlets 15, 16. The end port inlets 15 have an outboard end wall 20 which forms a smooth continuation of the inside wall 22 of the intake manifold to thereby maintain laminar flow into the port in this area and thus, end wall 20 may be perpendicular to interface surface 14. The intermediate port inlets 16, on the other hand, together with the inboard wall 24 of each end port inlet 15, are provided with arcuate walls 26 at their intersections with interface surface 14.

To obtain such arcurate walls 26, the interface surface 14 of the cylinder head is provided with vertical columnar structures 30, preferably semicylindrical, disposed adjacent both sides of each port inlet 16 and adjacent the inboard side of each end port inlet 15 in a position wherein the periphery of a column 30 becomes tangent to the port wall at its intersection therewith within the port inlet. The periphery of the columnar structures 30 are further disposed to be approximately tangent to or slightly recessed from the plane in which the planar manifold sealing periphery 13 lies. When viewing the cylinder head 10 toward the intake manifold side of the head 10, the columnar structures 30 appear as columns 30 framing the port inlets. Vertical bores 31 may be drilled through some or all of the columnar structures 30 to accommodate cylinder head bolts(not shown) therethrough for attaching the head 10 to the engine.

Between adjacent port inlets 15, 16, the columnar structures 30 are separated from one another by a depressed chamber 32 formed by wall 33 which is inwardly recessed into the cylinder head 10 from the planar surface 13 at least a depth D equal to the radius of the columnar structures 30, the wall 33 being blended by appropriate radii substantially smaller than the radius of columnar structures 30 into the columnar peripheries thereof. Each depresssed chamber 32 is thus also framed by the columnar structures 30 bordering same.

The top and bottom wall surfaces 34 and 36 respectively of the cylinder head 10 formed by the planar periphery 13 are provided with bolt holes 38 tapped thereinto so that the entire interface surface 14 can be isolated from the ambient environment when the intake manifold 18 is abutted and sealed against the cylinder head 10 with which it is to be mated. It will be seen tha the intake manifold 18 includes bolt holes 42 along a peripheral flange 44 thereof which will align with the bolt holes 38 in the cylinder head 10 for providing means by which mating and sealing engagement of the cylinder head 10 and intake manifold 18 can be obtained.

It has been found through empirical testing that a significant increase in airflow into the port inlets 15 and 16 is provided by the improved design of the intake manifold interface surface of cylinder head 10 defined above, particularly by the provision of the depressed chamber 32. More specifically, it has been found through air flow bench tests that a cylinder head configuration having the depressed chamber 32 will have a significantly lower Mach index factor, indicative of greater mass air flow through the intake port for each stroke of the engine piston than the same head configuration without the depressed area. The improvement results in improvement of the volumetric efficiency of the engine on which the head is installed and, assuming the head and ports are properly matched to the combustion chamber and fuel injection system, improved fuel efficiency of the engine.

Although the reason for the improvement due to the depressed chamber 32 is not fully understood, it is believed that the depression may provide a chamber into which the boundary flow laterally along the interface surface may expand and thereby reduce the thickness of the boundary layer entering the port inlet. With the boundary layer thinner, the flow would be in closer proximity to the arcuate port inlet wall 26 and act, in accordance with the Coanda effect, to follow the port wall in laminar flow, thus enhancing flow into the port.

As described above, the cylinder head 10 of the present invention provides numerous advantages, some of which have been described above, and others of which are inherent in the invention. Also, modifications to the cylinder head 10 may be made without departing from the teachings of the present invention. For example, although the columns 30 are described herein as being semicylindrical, other arcuate shapes could be utilized as long as the depressed chamber 32 is provided for and the curvature is such as to maintain a smooth laminar flow around the arcuate surfaces and into the port inlet. Accordingly, the scope of the invention is only to be limited as necessitated by the accompanying claims.

I claim:

1. In an internal combustion engine cylinder head, said cylinder head having an intake manifold interface surface intersected by charge air intake port inlets having port walls, the improvement comprising arcuate columnar structures disposed laterally adjacent the intake port inlets thereof and having a periphery smoothly blended into the port walls to provide arcuate port inlets and a depressed chamber disposed between said columnar structures between adjacent port inlets, said depressed chamber being recessed into said cylinder head from the outermost periphery of said columnar structures.

2. The invention in accordance with claim 1 wherein said depressed chamber is recessed to a depth at least equal to a radius of curvature of said columnar structures.

3. The invention in accordance with claim 1 wherein said columnar structures are semicylindrical.

4. The invention in accordance with claim 3 wherein said depressed chamber is recessed to a depth at least equal to the radius of said columnar structures.

5. The invention in accordance with claim 1 and the inner wall of said depressed chamber being blended into the periphery of said columnar structures with a radius substantially lees than the radius of said columnar structure.

6. The invention in accordance with claim 1 and said cylinder head being provided with a planar sealing surface disposed peripherally about said interface surface and an intake manifold mated against said sealing surface, said intake manifold defining a plenum exposed to said adjacent intake port inlets.

7. The invention in accordance with claim 6 and said cylinder head having an end intake port having an outboard port inlet wall disposed to form a smooth continuation of the inner wall of said intake manifold, said end intake port inlet being characterized by the absence of said columnar structure adjacent said outboard wall and the presence of said columnar structure adjacent the inboard wall thereof.

8. In combination with an intake manifold defining a single plenum, a diesel engine cylinder head having a plurality of intake port inlets communicating with said plenum and having an interface surface intersected by said port inlets comprising arcuate columnar structures disposed on said interface surface laterally adjacent said intake port inlets and having a periphery smoothly blended into the port walls to provide arcuate port inlets, said interface surface further comprising a depressed chamber disposed between said columnar structures between adjacent port inlets, said depressed chamber being recessed into said cylinder head from the outermost periphery of said columnar structures.

9. The invention in accordance with claim 8 wherein said depressed chamber is recessed to a depth at least equal to a radius of curvature of said columnar structures.

10. The invention in accordance with claim 8 wherein said columnar structures are semicylindrical.

11. The invention in accordance with claim 10 wherein said depressed chamber is recessed to a depth at least equal to the radius of said columnar structures.

12. The invention in accordance with claim 11 and the inner wall of said depressed chamber being blended into the periphery of said columnar structures with a radius substantially less than the radius of said columnar structure.

13. The invention in accordance with claim 8 and said cylinder head being provided with a planar sealing surface disposed peripherally about said interface surface, said intake manifold being mated against said sealing surface.

14. The invention in accordance with claim 13 and said cylinder head having end intake having an outboard port inlet wall disposed to form a smooth continuation of the inner wall of said intake manifold, said end intake port inlet being characterized by the absence of said columnar structure adjacent said outboard wall and the presence of said columnar structure adjacent the inboard wall thereof.

* * * * *